US006335042B1

(12) United States Patent
Money

(10) Patent No.: US 6,335,042 B1
(45) Date of Patent: Jan. 1, 2002

(54) FOOD PACKS

(75) Inventor: Julian David Kyrle Money, Richmond (GB)

(73) Assignee: Pethick & Money Limited, London (GB)

( * ) Notice: Subject to any disclaimer, the term of this patent is extended or adjusted under 35 U.S.C. 154(b) by 0 days.

(21) Appl. No.: 09/743,974

(22) PCT Filed: Jul. 19, 1999

(86) PCT No.: PCT/GB99/02318

§ 371 Date: Feb. 26, 2001

§ 102(e) Date: Feb. 26, 2001

(87) PCT Pub. No.: WO00/03929

PCT Pub. Date: Jan. 27, 2000

(30) Foreign Application Priority Data

Jul. 17, 1998 (GB) ..... 9815683

(51) Int. Cl.[7] ..... B65D 85/00

(52) U.S. Cl. ..... 426/106; 229/87.08; 229/938; 426/124; 426/411

(58) Field of Search ..... 229/87.08, 938, 229/87.11, 87.09, 87.01, 117.32; 426/106, 124, 411; 383/119

(56) References Cited

U.S. PATENT DOCUMENTS

| | | | | | |
|---|---|---|---|---|---|
| 2,282,207 | A | * | 5/1942 | Palmer | 383/119 |
| 2,588,409 | A | * | 3/1952 | Olsen | 229/87.09 |
| 3,399,818 | A | * | 9/1968 | Stegner | 383/119 |
| 3,964,669 | A | | 6/1976 | Sontag et al. | |
| 4,267,955 | A | * | 5/1981 | Struble | 229/117.32 |
| 4,328,896 | A | | 5/1982 | Behne | |
| 4,575,000 | A | | 3/1986 | Gordon | |
| 4,723,700 | A | * | 2/1988 | Wischusen, III | 229/87.08 |
| 4,759,914 | A | * | 7/1988 | Wischusen, III | 229/87.08 |
| 5,565,230 | A | * | 10/1996 | Bailey | 426/411 |
| 5,921,681 | A | | 7/1999 | Money | |
| 6,016,950 | A | * | 1/2000 | Money | 229/87.01 |

FOREIGN PATENT DOCUMENTS

| | | |
|---|---|---|
| WO | WO 97/07037 | 2/1997 |

OTHER PUBLICATIONS

International Search Report; PCT/GB99/02318; Aug. 12, 1999; Bjorn Salen.

* cited by examiner

*Primary Examiner*—Stephen P. Garbe
(74) *Attorney, Agent, or Firm*—Fish & Richardson P.C.

(57) ABSTRACT

A food pack comprising a tray formed from card having a rectangular base with fold up side and end walls and a sheet of wrapping material extending over the tray and adhered to the side walls to receive a food item. The sheet is folded over the item across the tray and the folded ends of the sheet projecting from the ends of the tray are tucked between the base of the tray and the sheet extending across the base. The end walls of the tray have convexly curved fold lines with the base of the tray whereby the end walls of the tray are folded upwardly with respect to the base to enclose the wrapped food item with the side walls.

3 Claims, 6 Drawing Sheets

FOOD PACKS

This invention relates to food packs and is particularly, although not exclusively, applicable to fast food items such as burgers, bagels and the like.

WO 97/07037 discloses a pack for articles of good or other merchandise comprising a bag and a carton form for supporting a lower part of the bag having a base with a central fold line and walls hinged to the base along further fold lines to enable the carton and bag to be folded and to be erected to open the bag. The side walls of the lower part of the bag are secured to the side walls of the carton so that when the carton is erected by opening the folded base into a V-form, the bottom part of the bag is opened, as the V-form is progressively widened, the bag is tensioned by the walls moving apart until the base of the carton moves "over centre" and inverts to brace the lower part of the bag open to receive an article or articles to be packed therein. No provision is made for enclosing the ends of the bag wrapped over the enclosed article.

U.S. Pat. No. 4,575,000 discloses a wrapper for a food product such as a hamburger which is defined by an outer layer of paperboard and an inner layer of glassine type of paper. The outer and inner layers are of generally rectangular form, the glassine type of paper extending beyond the side edges of the paperboard and having top and bottom edges, a major portion of each edge having radiused cutouts. The paperboard and glassine type of paper are joined by a narrow adhesive strip running lengthwise and centrally of them. The ends of the paperboard have hinged and relatively narrow locking panels. In use, a food product such as a hamburger is placed on top of the glassine type of paper at its midlength. The wrapper is folded around the hamburger to form a tube, the wrapper ends being secured together by twisting the locking panels, with the glassine type of paper extending from both ends of the tube being bunched together and tucked in beneath the hamburger, between it and the paperboard.

This invention provides a food pack comprising a tray formed from card having a rectangular base with fold up side walls and a sheet of wrapping material having a lower portion extending over the base of the tray and having side wall portions adhered to the sidewalls of the tray to receive a food item, the side walls of the sheet being brought together across the tray over the item and folded ends of the sheet projecting from the ends of the tray being tucked between the base of the tray and the lower portion of the sheet extending across the base; wherein the side walls have straight folds with the base, and the tray has end walls having curved fold lines with the base to snap upwardly, normal to the base of the tray and to impart a curved formation to the base, the end walls enclosing the wrapped food item with the sidewalls and covering the tucked-in ends of the wrapping material.

Preferably the end walls have folds which are convexly curved into the base so that the base is formed with an upwardly concave form wherein the end walls are snapped upwardly with respect to the base.

It is also preferred that the sheet of wrapping material is generally rectangular and is located at its centre in the tray.

Preferably the sheet of wrapping material is generally rectangular and is located at its centre in the tray.

The following is a description of a specific embodiment of the invention, reference being made to the accompanying drawings, in which:

FIG. 1 illustrates a blank for forming a tray of a food pack for a burger, bagel or the like;

Figure 1:
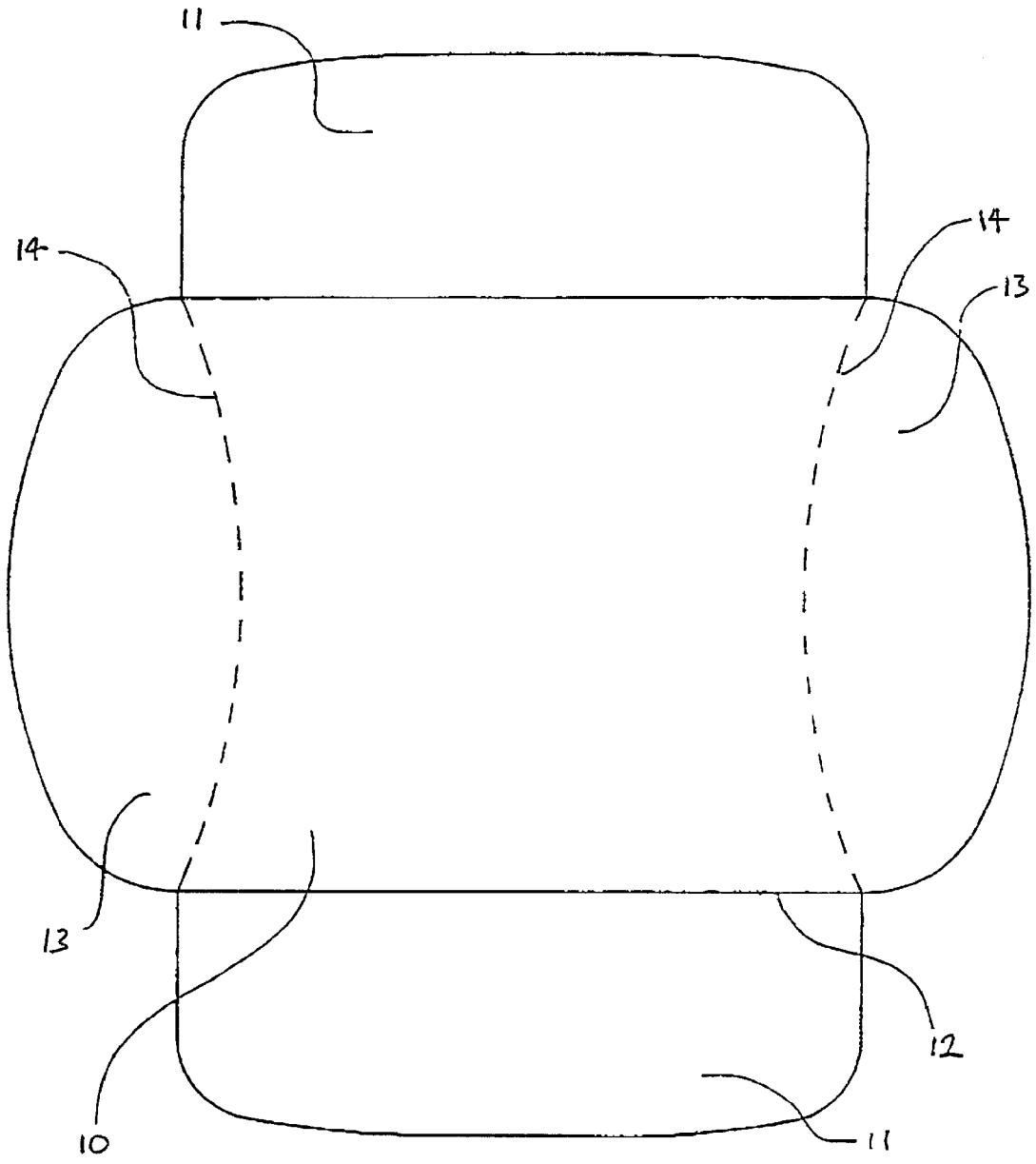

Reference is made firstly to FIG. 1 of the drawings which shows a cardboard blank for a tray in which a food item such as a burger or bagel is to be wrapped and held for sale. The blank is formed from card and comprises a generally rectangular base 10 having rectangular sidewalls 11 hinged alongside fold lines 12 to the side edges of the base. The tray has end walls 13 hinged along concavely curved fold lines 14 to the end edges of the tray. The curved fold lines between the end walls and base ensure that when the base is curved downwardly between the sidewalls, as described later, the end walls will either snap into line with the base or project upwardly generally at right angles to the base.

Figure 2:
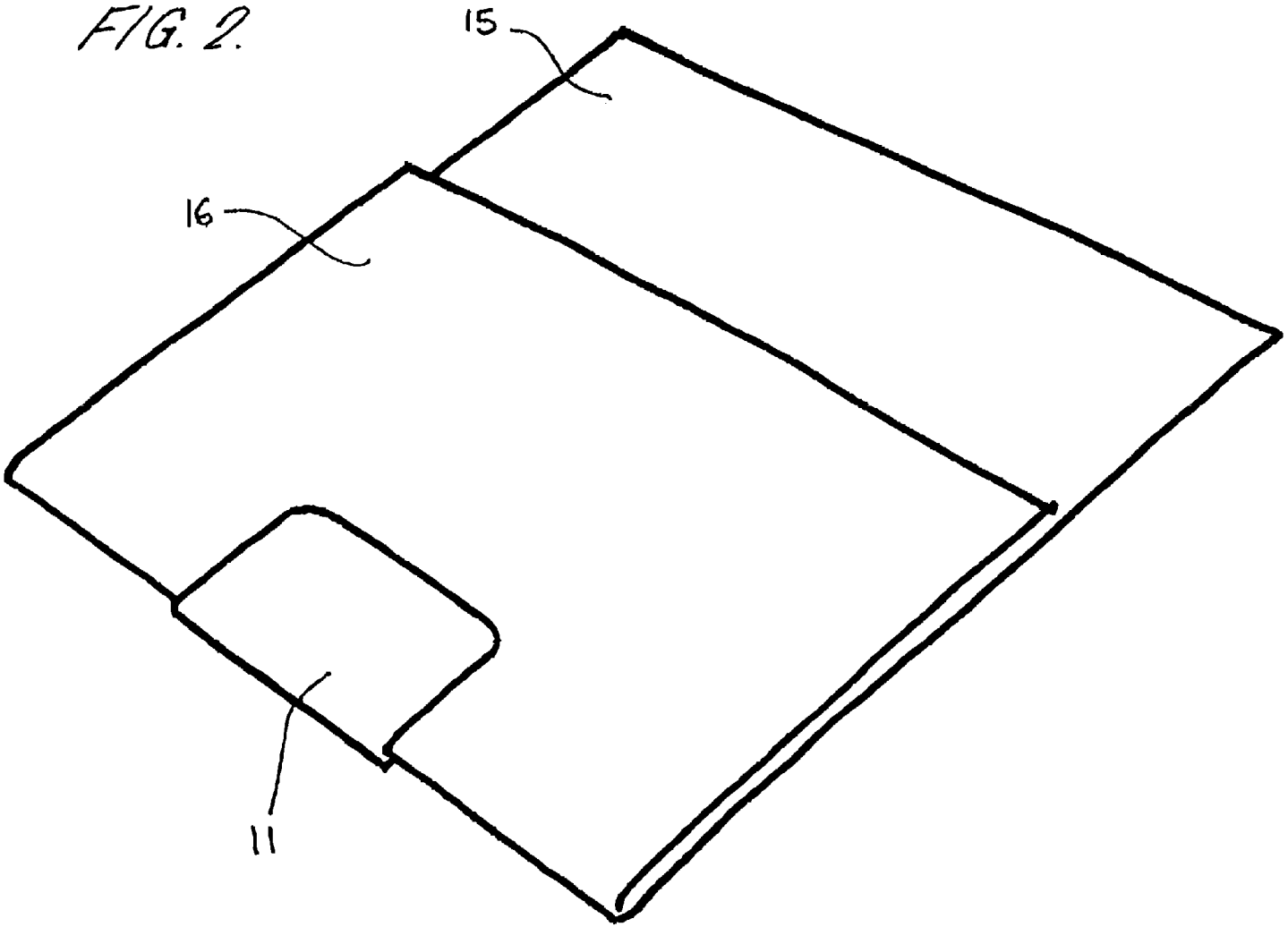
FIG. 2 is a diagrammatic view of the food pack in flat form including a folded sheet of wrapping material extending over the tray blank.
Figure 3:
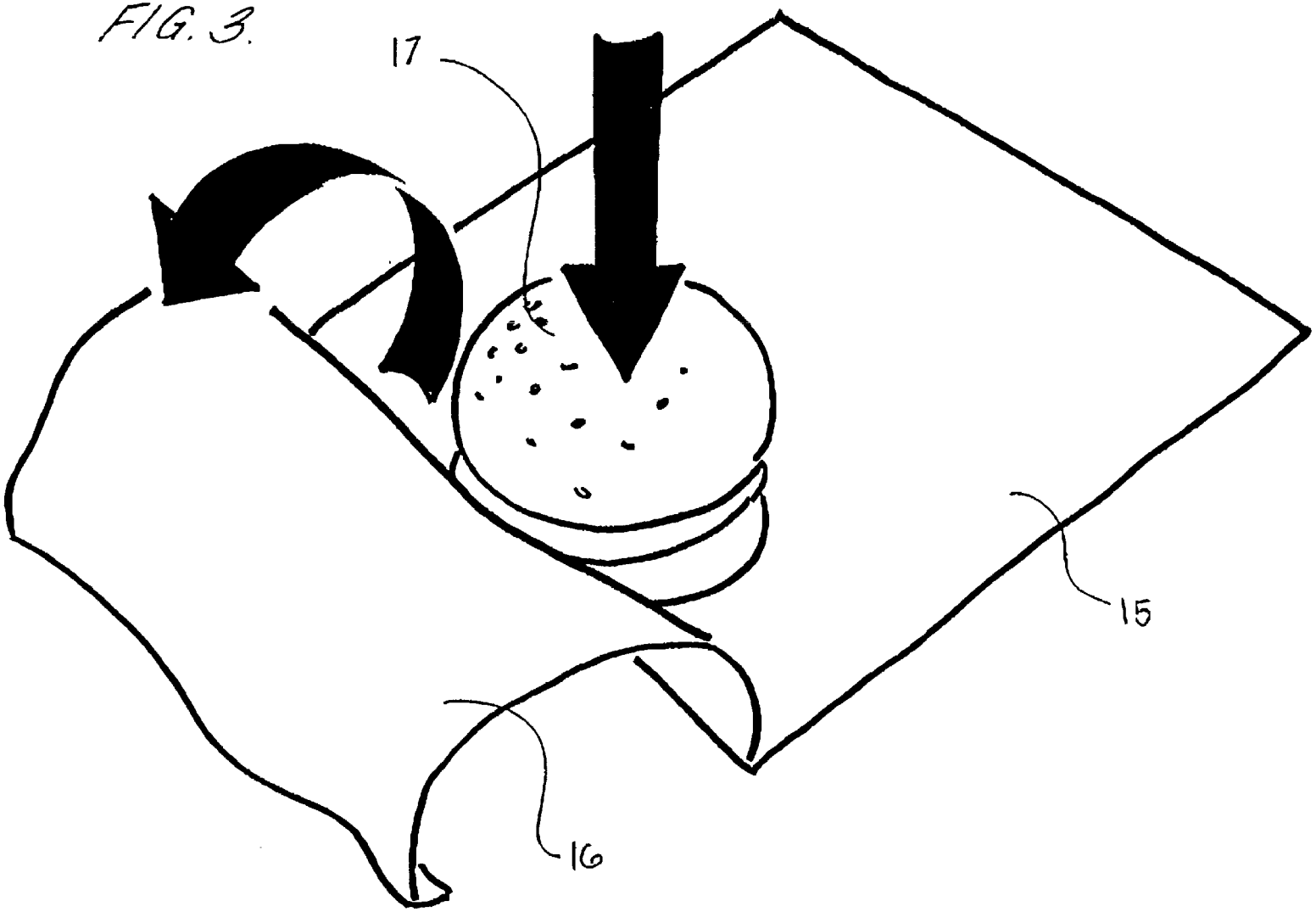
FIG. 3 shows the food pack of FIG. 2 with the sheet of wrapping material unfolded to receive a burger.
Figure 4:
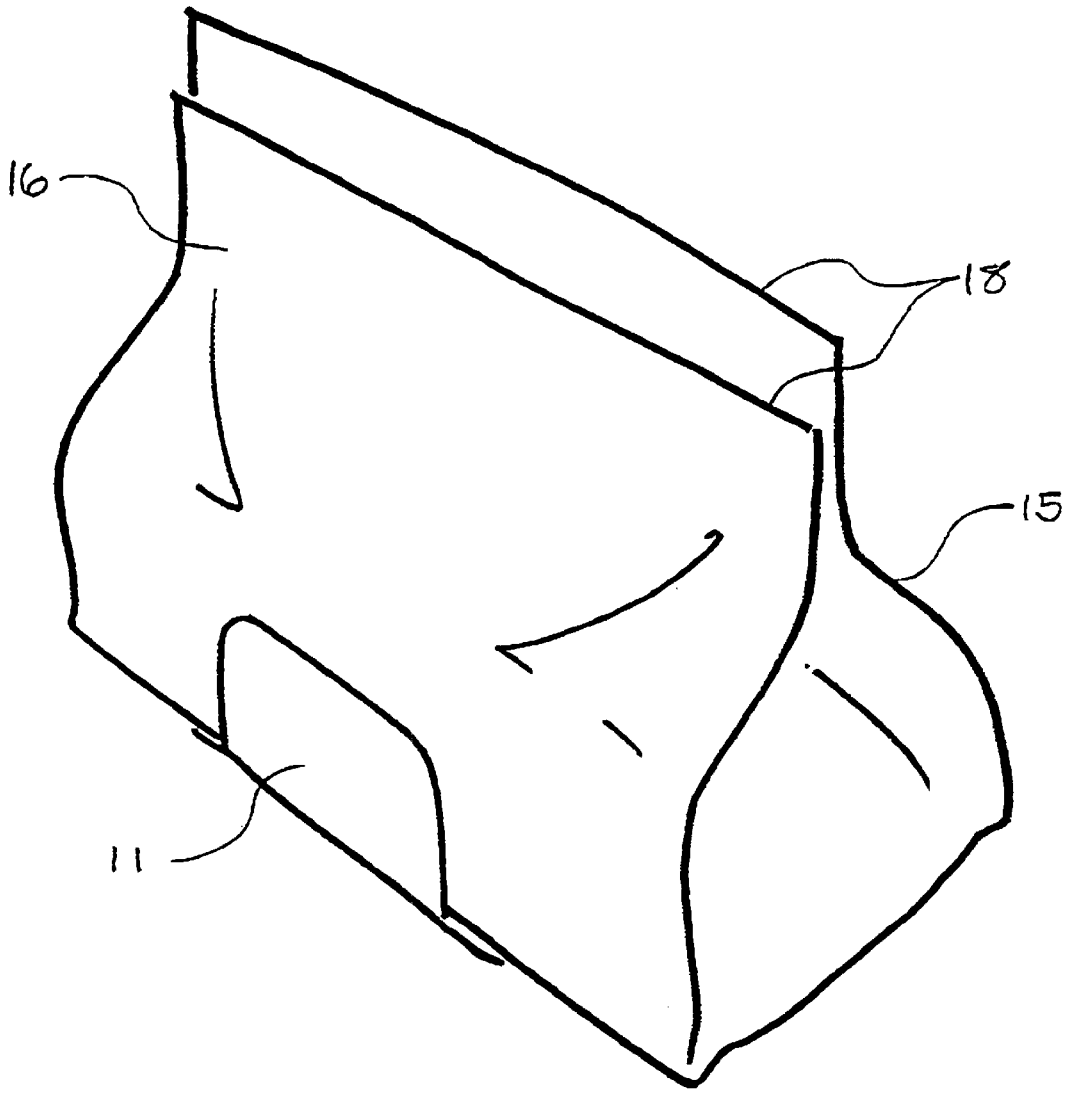
FIG. 4 is a perspective view of the pack with the side edges of the sheet material pulled together over the burger.

Referring now to FIG. 2 of the drawings, there is shown a complete food pack in flat form in which a large rectangular sheet of material 15 extends over the tray blank with the sidewalls 11 of the blank secured to the sheet. A portion 16 of the sheet is folded over in line with one of the fold lines of a sidewall 11 and the base of the tray to reduce the overall size of the blank form. To complete a pack, the folded over portion 16 of the sheet is raised lifting the sidewall 11 with it and a burger 17 or other food item is placed on the upper surface of the sheet against the folded sidewall as shown in FIG. 3. The side edges 18 of the sheet are then drawn upwardly together as shown in FIG. 4 lifting the other sidewall 11 of the tray to bring the sheet together over the burger.

Figure 5:
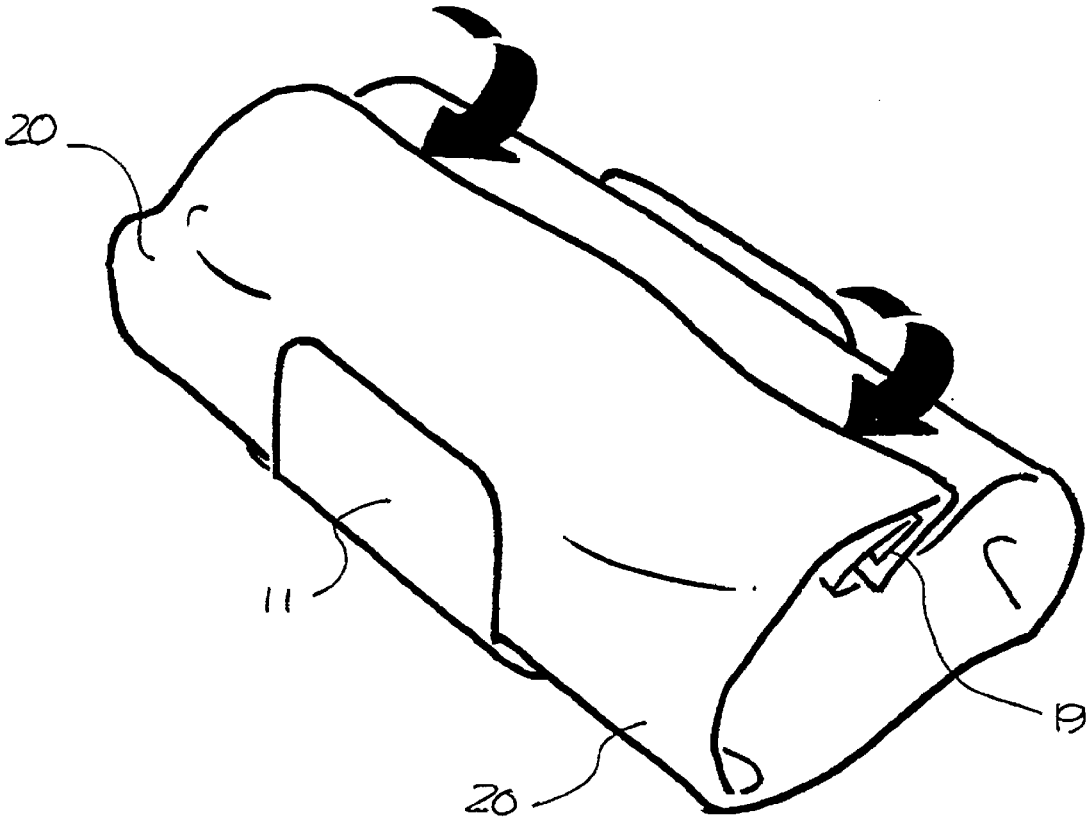
FIG. 5 shows the good pack with the side edges of the wrapping material folded over.
Figure 6:
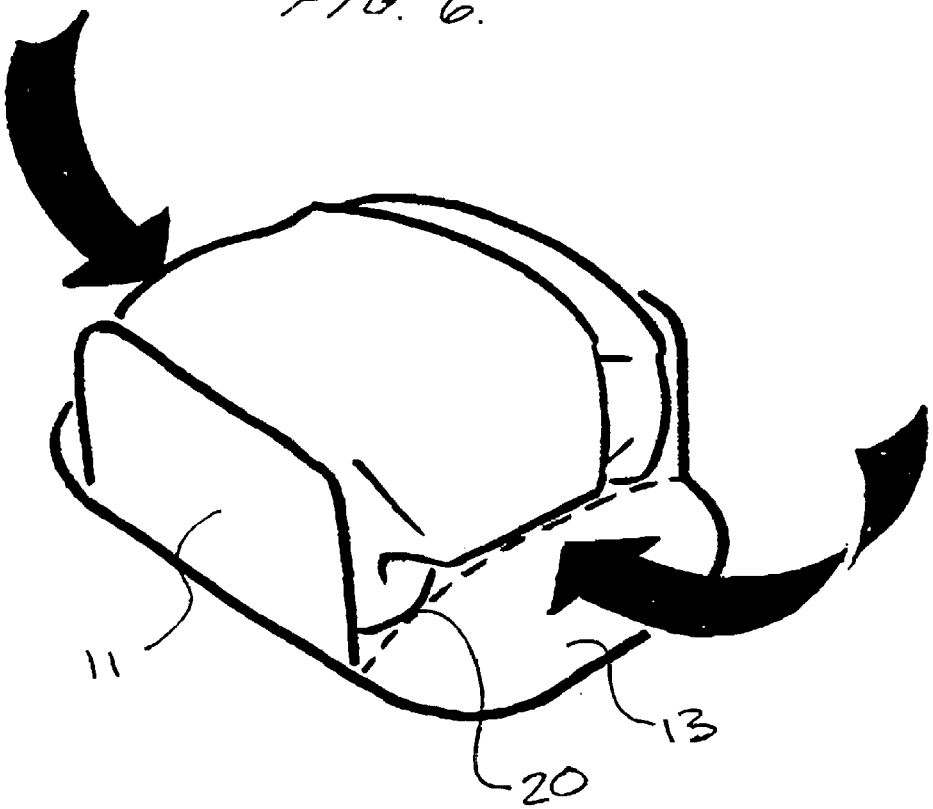
FIG. 6 shows the food pack of FIG. 4 with the ends of the folded wrapping material tucked between the burger and over the tray.
Figure 7:
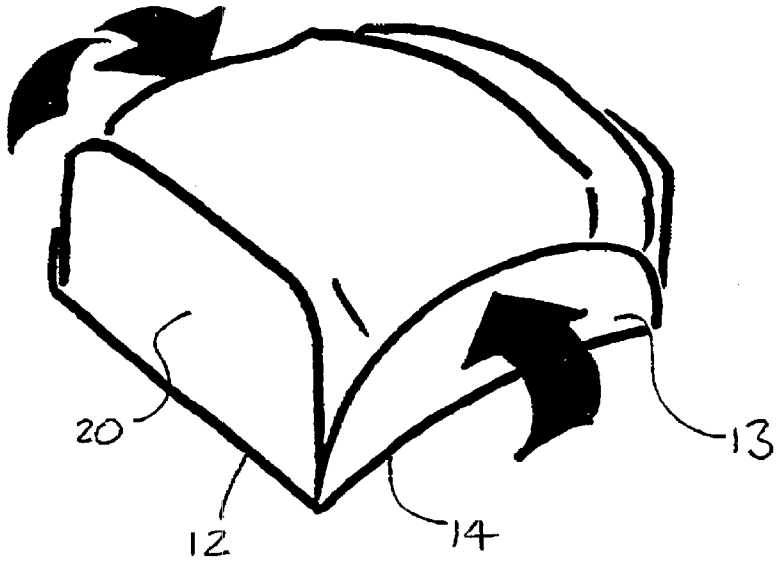
FIG. 7 shows the food pack with the ends of the tray folded up to protect, with the sidewalls, the burger enclosed in the wrapping material.

The side edges 18 of the sheet are then folded over to make a first flap 19 and then folded over again to draw the sheet tightly over the food item as shown in FIG. 5. The end portions 20 of the sheet are then tucked into the gap between the base of the tray and the burger thus causing the base of the tray to become downwardly curved between its sidewall. The end walls can then be snapped up against the burger to enclose the tucked in ends of the sheet and to complete the pack as shown in FIG. 7.

What is claimed is:

1. A food pack comprising a tray formed from card having a rectangular base (10) with fold up side walls (11) and a sheet of wrapping material having a lower portion extending over the base of the tray and having side wall portions (15, 16) adhered to the sidewalls of the tray to receive a food item (17), the side walls of the sheet being brought together across the tray over the item and folded ends of the sheet projecting from the ends of the tray being tucked between the base of the tray and the lower portion of the sheet extending across the base; characterised in that the side walls have straight folds (12) with the base (10); and in that the tray has end walls (13) having curved fold lines (14) with the base to snap upwardly, normal to the base of the tray to impart a curved formation to the base, the end walls enclosing the wrapped food item with the sidewalls and covering the tucked-in ends of the wrapping material.

2. A food pack as claimed in claim 1, characterised in that the end walls (13) have folds (14) which are convexly curved into the base (10) so that the base is formed with an upwardly concave form wherein the end walls are snapped upwardly with respect to the base.

3. A food pack as claimed in claim 1 or claim 2, wherein the sheet of wrapping material (15) is generally rectangular and is located at its centre in the tray.

* * * * *